United States Patent [19]

Rodrigue

[11] 4,259,943

[45] Apr. 7, 1981

[54] FUEL ECONOMIZER

[76] Inventor: Andrew A. Rodrigue, 27 Elm St., Lewiston, Me. 04240

[21] Appl. No.: 74,325

[22] Filed: Sep. 11, 1979

[51] Int. Cl.[3] ..... F23L 3/00

[52] U.S. Cl. ..... 126/292; 110/163; 236/45

[58] Field of Search ..... 126/292–295, 126/312, 288, 285 A, 285 R, 307 A; 236/45; 110/163; 98/116; 137/527.8; 251/338

[56] References Cited

U.S. PATENT DOCUMENTS

| | | | |
|---|---|---|---|
| 2,358,260 | 9/1944 | Simpson | 251/338 |
| 3,941,067 | 3/1976 | Nicolas | 110/163 |
| 3,987,785 | 10/1976 | Long | 236/45 |

FOREIGN PATENT DOCUMENTS

| | | | |
|---|---|---|---|
| 508204 | 9/1930 | Fed. Rep. of Germany | 110/163 |
| 2062811 | 6/1972 | Fed. Rep. of Germany | 110/163 |

*Primary Examiner*—James C. Yeung

*Attorney, Agent, or Firm*—Wolf, Greenfield & Sacks

[57] ABSTRACT

A fuel economizer, for mounting in a flue pipe between a furnace and a chimney, having a lateral vane overlying a cutout in the flue pipe and carrying a baffle plate in between ends thereof mounted transversely to the flue pipe to obstruct a portion of the passageway therein. A housing overlies the vane. Hinge and weight means are attached to the vane and baffle plate to permit opening of the baffle plate, in response to gas pressure exerted on an interior surface of the vane, and closing down thereof, to maximize efficiency of the furnace by providing a properly sized flue outlet during different phases of use of the furnace.

4 Claims, 5 Drawing Figures

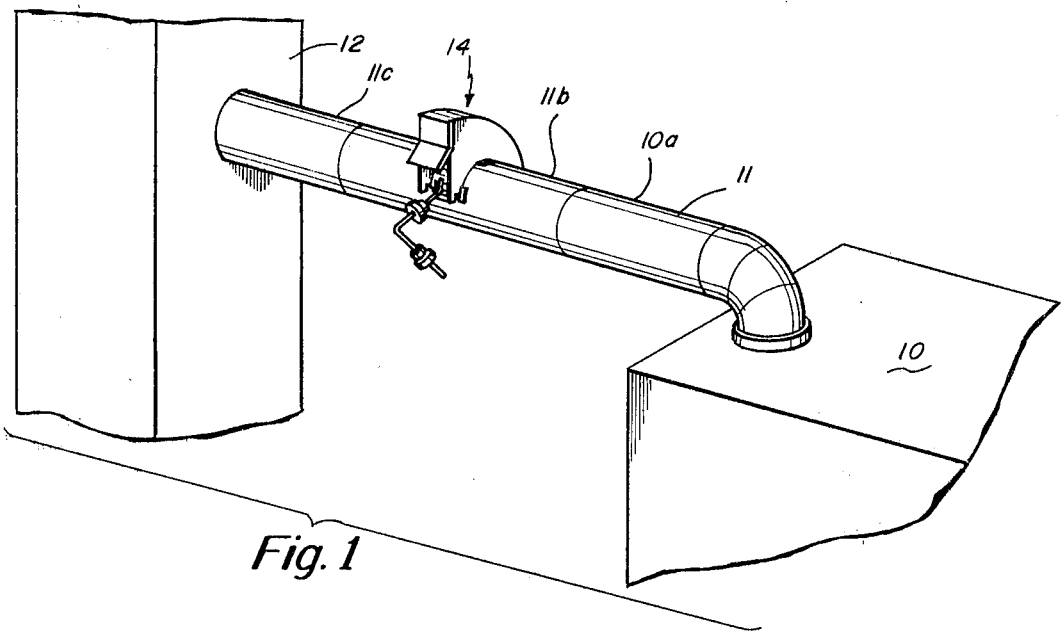
Fig. 1
Fig. 2
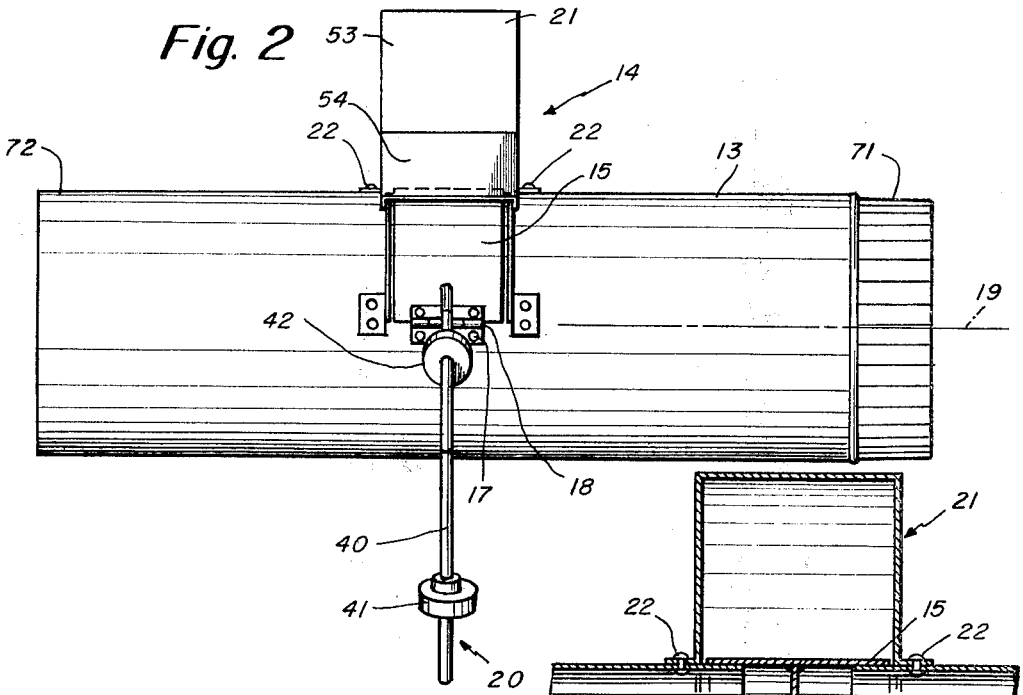
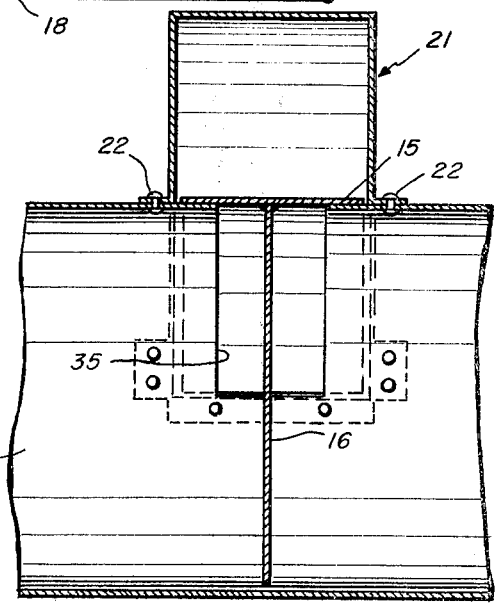
Fig. 4

FUEL ECONOMIZER

BACKGROUND OF THE INVENTION

Particularly in the home heating area, countless furnaces of the gas and oil-fired type are used having flue pipes leading to chimneys or exhaust stack outlets. There has been difficulty in maximizing the efficiency of the flue pipe passageway cross section in order to maximize efficiency of the furnace and thus cut down the fuel requirements of the furnace to obtain best fuel efficiency and heat output. Often conventional procedure has been to merely insert a lateral flapper which in no way obstructs the flue pipe. Several flue pipe obstructing and adjusting dampers have also been suggested. These include various devices which operate substantially within flue pipe passagways by pivoting about axes perpendicular to the axis of the passageway. Such devices are disclosed in the following U.S. patents inter alia:

U.S. Pat. Nos. 1,599,063-Pawson; 2,441,398-D'Elia; 2,557,210-Viola et al; 2,735,385-De Ascentiis; 2,783,756-Crozier; 2,819,845-Ziph; 3,987,785-LeBeau; 4,046,318-Ripley.

SUMMARY OF THE INVENTION

It is an important object of this invention to provide a fuel economizer device for mounting in a flue pipe between a furnace and a chimney which device provides a proper output flue passageway in different modes of the furnace and which is self-adjusting by mechanical means, certain of operation and consistent in operation.

Still another object of this invention is to provide a fuel economizer device in accordance with the preceding object which has automatic operation of a transverse baffle partially obstructing a flue passageway and carrying a lateral vane pivoted about an axis parallel to the axis of the passageway and capable of automatic adjustment by weights to provide for positive operation in response to changed conditions in the furnace.

Still another object of this invention is to provide means for permitting efficient operation of a furnace in various modes by a fuel economizer device in accordance with the preceding objects which maximizes efficiency of a furnace with minimized fuel usage and which can be easily mounted in new or existing furnace constructions.

According to the invention, a fuel economizer for mounting in a flue pipe between a furnace and a chimney has a lateral vane. The lateral vane overlies a cutout in a flue pipe and carries a baffle plate preferably in between ends thereof, for mounting transverse to the flue pipe to obstruct a portion of a passageway therein. Mounting means permit reciprocal pivoting of the vane and attached baffle plate transverse to the passageway and preferably along an axis of a hinge which axis is parallel to the axis of the flue passageway. Adjustable weights are preferably connected to the vane to balance it in a normally closed position while permitting opening thereof automatically in response to gas pressure exerted on an interior surface of the vane. A vane housing overlies the vane preferably enclosing ends of the vane and an arcuate cutout in the flue pipe through which the baffle extends.

It is a feature of this invention that all conventional dampers can be eliminated, yet, furnace efficiency is maximized. Transfer of heat energy of the burning fuel to the furnace is maximized and heat loss to the stack is minimized. The device of this invention can be constructed in a unit which is easily attachable to existing flue pipes or can be mounted on flue pipe sections to replace existing sections of the pipe rapidly in minimized installation procedures.

BRIEF DESCRIPTION OF THE DRAWINGS

The above and other objects, features and advantages of the present invention will be better understood from the following specification when read in conjunction with the accompanying drawings in which:

FIG. 1 is a perspective view of a conventional furnace and smoke stack chimney arrangement;

FIG. 2 is a side view of a preferred embodiment of a fuel economizer device in accordance with the present invention;

FIG. 4 is a cross sectional view thereof taken through line 4—4 of FIG. 3.

DESCRIPTION OF THE PREFERRED EMBODIMENTS

Figure 3:
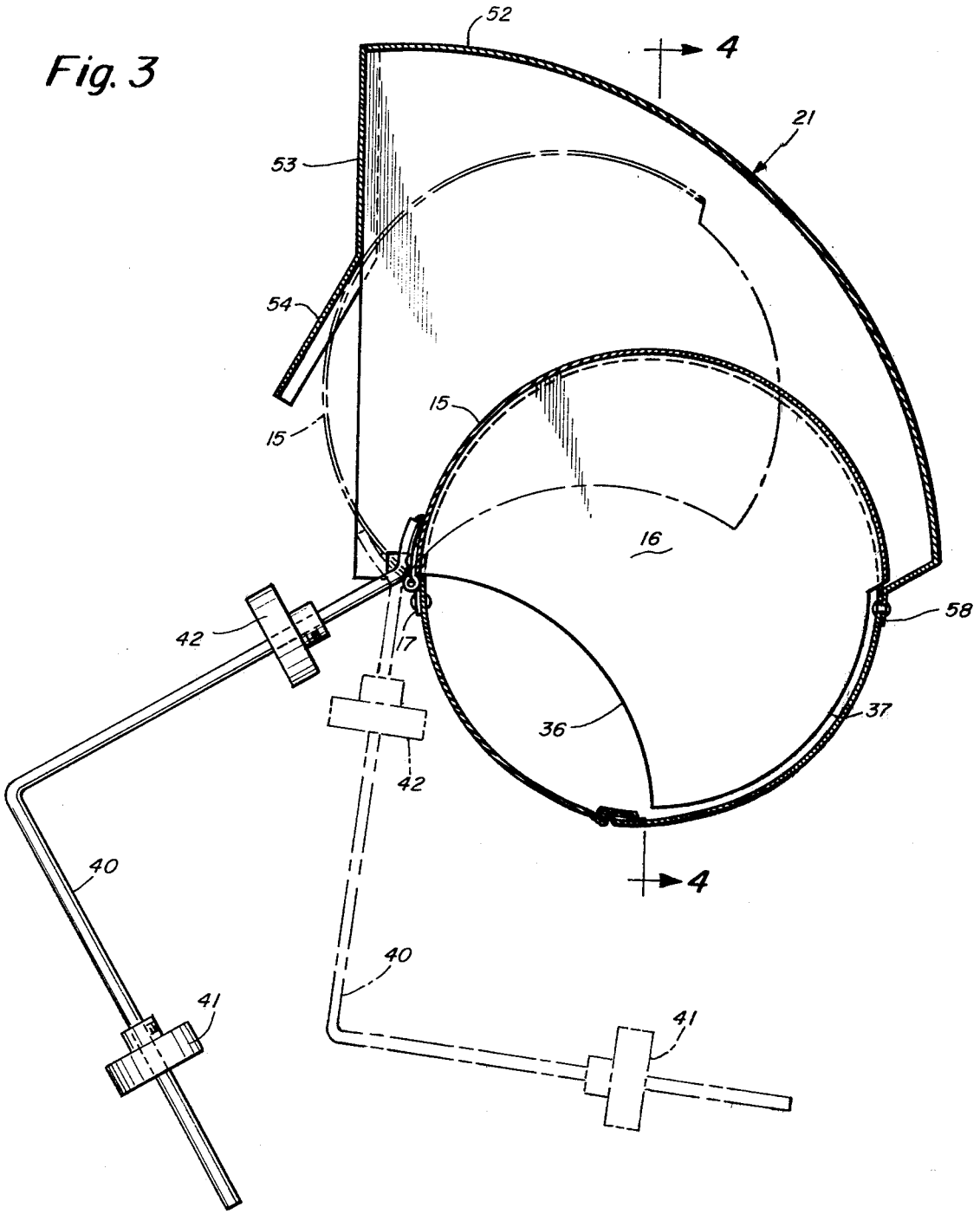
FIG. 3 is a front end view thereof in a closed position with the opened position shown in dotted outline.

With reference now to the drawings and more particularly FIG. 1, a typical furnace and chimney arrangement is shown. A furnace 10 is connected to an exhaust flue pipe 11 made up of a number of sections of thin, galvanized sheet metal pipe. The pipe forms an elongated passageway leading to a chimney stack 12. Three sections 10*a*, 11*b* and 11*c* are shown but any number of sections can be used and are preferably at a slight upward angle toward the stack. The flue pipe passageway provided often has side dampers or other means therein all of which are rendered unnecessary by the present invention. According to the invention as shown in FIG. 2, a flue pipe 13 of galvanized sheet metal is provided to act as a base for the fuel economizer device 14 of this invention. The fuel economizer device 14 comprises a lateral vane 15 carrying a transverse baffle plate 16 attached thereto and a hinge 17 having an axis pin 18 parallel to an imaginary axis 19 of the elongated flue pipe section 13. A weight means 20 is attached to the vane. A hood or enclosure 21 overlies the vane and is attached to the pipe with conventional sheet metal screws such as 22.

Figure 5:
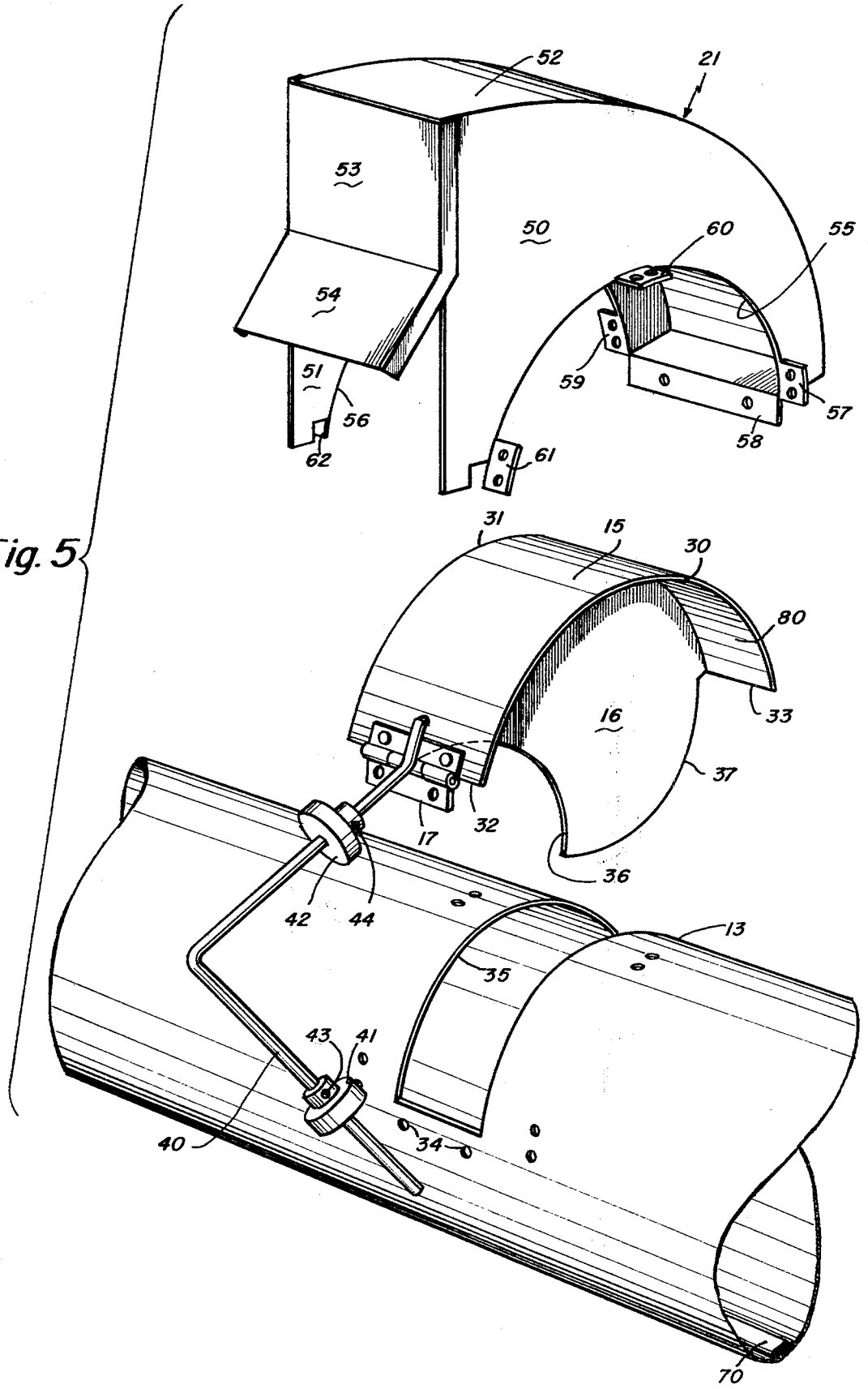
FIG. 5 is an exploded perspective view thereof.

As best shown in FIG. 5, the lateral vane 15 is preferably arcuate in cross section and has a first end 30 and a second end 31 with side edges 32 and 33. The hinge 17 is mounted at edge 32 by sheet metal screws and to the pipe 13 by other sheet metal screws as at holes 34. The vane overlies and completely closes an arcuate rectangular-shaped cutout 35 in the pipe 13. For example, there may be a half inch or more overlap by the arcuate vane 15 of the edges of cutout 35. Th vane arc corresponds to the arc of the cutout so that in the closed condition, the lateral vane substantially closes the cutout 35. Preferably both the lateral vane and the arcuate cutout are substantially perpendicular to a radius from the axis 19 of the pipe 13. The baffle plate 16 is spot welded to the lateral vane and is preferably substantially perpendicular to the vane and to the axis 19. A lower end of the baffle plate has an arcuate cutout at 36 which provides for a predetermined, minimum, constantly opened, cross section of the pipe 13 even in the closed position of the vane and baffle as best shown in full lines in FIG. 3. A side notch of arcuate shape is preferably provided at 37 to enable pivoting of the baffle plate to the dotted line position shown in FIG. 3 without obstruction by the side wall portion of the stovepipe 13. This cutout notch also provides a predetermined area of stovepipe cross section which is always open to passage of gas.

The lateral vane is preferably maintained in position by counter-balancing of weighted means provided by a right angle bent rod 40 carrying adjustable weights 41 and 42. The weights 41 and 42 can be slid along their portions of the rod and fixed in position by set screws 43 and 44. These weights are preferably adjusted so as to maintain the lateral vane in the closed position, that is, the full line position of FIG. 3, when the furnace is cold and there is no gas passage through the pipe 13.

The enclosure or hood 21 has parallel end plates 50 and 51 joined together by an arcuate enclosing wall 52 and an end wall 53 having an outwardly angled extension piece 54. Bent over flaps 55 on either side of the end wall 53, are spot welded or soldered to substantially enclose the hood. Lower portions of walls 50 and 51 are arcuate as at 55 and 56 to mate with the arc made by the wall of pipe 13 and substantially seal therewith. The hood is mounted in position using sheet metal screws through tabs 57, 58, 59, 60, 61 and 62. The hood is dimensioned to permit arcuate movement of the lateral vane 15 from the full line position to the dotted line position shown in FIG. 3. The hood can act as a limit to the fully opened position of the vane although in normal operation, the vane never touches the hood nor reaches the fully opened position.

In the preferred embodiment, the stovepipe 13 has an inside diameter of 9 inches and is formed of galvanized sheet metal, as known in the art, having a longitudinal seam 70 with ends 71 and 72 adapted to mate with similar stovepipe sections. Baffle plate 16 is basically an $8\frac{3}{4}$ inch circular disc having a cutout notch 37 averaging about $\frac{1}{4}$ inch wide and extending about 60% of the circumference of the disc with a portion thereof cut out at 36 which together with the notch amounts to a cutout area of about 4 square inches. The vane 15 is substantially a rectangle when flattened having a length of $13\frac{1}{2}$ inches and a width along side 32 and 33 of $3\frac{1}{2}$ inches overlying the cutout 35 which cutout if flattened would have a length of $13\frac{1}{2}$ inches and a width of $1\frac{1}{4}$ inch. The vane 15 is attached by a conventional door hinge 17, using sheet metal screws, having an axis pin parallel to the axis 19. Weights 41 and 42 are 13 ounces each and the rod 40 has each leg with a length of 9 inches. The maximum closed position of the baffle blocks less than 80% of the flue pipe and often about that amount. The hood 21 allows approximately about 90% of the disc to pivot out of the passageway in the maximum opened position.

In operation of the device of this invention, the pipe 13 with the economizer device 14 mounted thereon is used to replace a pipe such as 11*b*. Preferably the economizer 14 is positioned as near to the stack or chimney 12 as it can be conveniently positioned when replacing an existing stovepipe section.

The weights are adjusted so that in the cold, or off position, of the furnace, the vane is in the closed position shown in full line in FIG. 3. When the furnace turns on, the initial gas movement acts against the undersurface 80 on the furnace side of the economizer vane and pushes the vane upwardly to a dotted line position of FIG. 4 or something intermediate that position and the closed position. As the furnace heats up, the vane slowly comes back toward its original position and substantially closes allowing a predetermined and correct opening in the stovepipe passageway to maximize heat retention in the furnace and minimize exhaust, consistent with maximized operation of the furnace. Preferably the weights are adjusted to cause some opening of the vane even with very slight gas flow. The baffle in effect throttles the flue pipe down to increase furnace temperature for a given oil or fuel consumption rate to result in oil or fuel saving. When the furnace burner turns off, the fully closed position shown in full lines of FIG. 4 is resumed automatically by the action of the weight thus maintaining heated air in the furnace over a prolonged period of time but leaving an emergency outlet 36. The interior surface 80 and corresponding surface at the other end of the vane 15 adjacent edge 31, act to receive gas pressure to open and close the vane in response to operation of the furnace or downdraft conditions respectively. When the vane is opened, some furnace gas will flow past the baffle 16 and surface 80 out into the hood area but, draft on the stack side of the pipe will pull that furnace gas back through the cutout 35 on the stack side of the baffle. Thus there will be a flow within the pipe and a second flow of gas in the hood going from one side of the baffle plate 16 back to the other side of the baffle pipe and up the stack.

The fact that the baffle is visible to the eye at the side of the flue pipe provides for safe operation. If the baffle sticks or is obstructed in any way, the blockage can readily be determined and corrections made. The side opening also permits ease of cleaning without the need for disassembly of the flue pipe.

In an example of use of the invention, a forced hot water oil heating furnace having a 9 inch flue pipe was measured in its operation. The furnace was an American Standard Furnace with boiler having the following specifications: steam 15 psi, water 30 psi, gross output 268 MBH, rating water 233.0, firing rate per hour 2.50, net steam 838, Serial # 2BJ1, Boiler #A37M, burner American Standard Arcoflame Model DH5 No. 3 disturbulance 1.80 to 2.50 gallons per hour, $\frac{1}{3}$ horsepower, 1,725 rpm's.

The following results were obtained prior to installing a fuel economizer 14 in accordance with this invention with the furnace firing at $2\frac{1}{4}$ gallons of home heating oil per hour:

Draft running 0.04
Draft over fire 0.02
Smoke #1
Temperature 550° F. taken at the breach
$CO^2$ 9–$\frac{1}{2}$%
Efficiency 76–$\frac{1}{2}$%

When the device 14 was installed in the above furnace, the temperature rose to 1,000° F. Safe operating temperature was obtained by reducing the jets to get a temperature of 450° F. firing at $1\frac{1}{2}$ gallons of oil per hour with the following results:

Draft running 0.0
Draft over fire −1
Smoke #1
Temperature 450° F.
$CO^2$10%
Efficiency 80–$\frac{1}{2}$%

The type of furnace which can be benefited by the fuel economizer of this invention can be substantially any furance having a conventional stovepipe outlet to a stack or chimney. Such furnaces include gas and oil-fired furnaces. The word "furnace" is meant to include the heating areas of boilers and the like which have flues leading to stacks. The stack or chimney can be of any conventional type.

While the stovepipe is shown as a circular cross section pipe, other cross sections can be used. In such case, the vane 15 could vary from arcuate to conform to the outer configuration of the stovepipe be it square, rectangular or the like.

While the unit is preferably used as a preassembled unit on a stovepipe section 13, which stovepipe is inserted in place of an existing stovepipe in existing constructions, other constructions are possible. For example, the seam line 70 of the stovepipe 13 can be split, the unit 13 can then be mounted on a conventional stovepipe such as 11*b* merely by forming a corresponding arcuate slit 35 at 11*b* placing the stovepipe 13 thereover and clamping it in place by clamps around the circumference thereof (not shown). Alternately a slot such as 35 can be cut directly in section 11*b*, a baffle and vane assembly with attached weight means and hinge can be mounted over the slot by screwing of the hinge 17 to the edge of the slot and a cover 50 mounted thereover without removing the section 11*b*.

What is claimed is:

1. A fuel economizer device for mounting in a flue pipe between a furnace and an exhaust stack, said device comprising, a lateral vane for overlying a cutout in a flue pipe and carrying a baffle plate for mounting transversely to said flue pipe to obstruct a portion of passageway therein, mounting means for permitting movement of said vane and attached baffle plate transverse to said passageway with said baffle plate moving substantially in a plane poartially into and out of said passageway, wherein said mounting means permits reciporcal pitting, weighted means connected to said vane to maintain it in a normally closed position yet permitting opening thereof in repsone to gas pressure exerted on an interior surface of said vane, a vane housing overlying said vane, and said vane housing comprising a hood for permitting gas flow from a powtion of said cutout over one side of said baffle plate around said vane and to another side of said faffle plate within said flue pipe.

2. A fuel economizer device in accordance with claim 1 wherein said baffle plate defines a blocking area less than the cross sectional area of said flue pipe.

3. A fuel economizer device in accordance with claim 2 wherein said baffle plate defines an arcuate notch at one end thereof and a cutout adjacent said notch with said notch acting to prevent binding of said plate against a wall of said flue pipe when said plate is pivoted into and out of said flue pipe passageway.

4. A method of providing for fuel economy in the operation of a furnace connected to an exhaust stack by a flue pipe, said method comprising providing an opening in said flue pipe, positioning a baffle plate transversely to a passageway in said pipe in a closed position whereby said baffle plate does not fully close said opening, said baffle plate carrying an arcuate, lateral vane positioned to have a first end interior surface and a second end interior surface exposed to gas in said passageway, said vane and baffle being biased about a pivot point into said closed position, and passing a flue gas through said flue at a pressure sufficient to pivot said vane to a partially opened position thereby moving said baffle substantially in a plane and causing a gaseous flow from a first face of said baffle plate around said lateral vane and back into said flue passageway.

* * * * *

UNITED STATES PATENT AND TRADEMARK OFFICE

CERTIFICATE OF CORRECTION

PATENT NO. : 4,259,943

DATED : April 7, 1981

INVENTOR(S) : Andrew A. Rodrigue

It is certified that error appears in the above—identified patent and that said Letters Patent is hereby corrected as shown below:

Column 1,line 17, cancel "passagway" and substitute --passageway--. Column 2, line 57, cancel "Th" and substitute --The--. Column 4, line 68, cancel "furance" and substitute --furnace--. Column 5, claim 1, line 32, after "of" and before "passageway" insert --a--. Column 5, claim 1, line 37, cancel "poartially" and substitute --partially--. Column 5, claim 1, line 40, cancel "reciporcal" and substitute --reciprocal--. Column 6, claim 1, line 3, cancel "repsone" and substitute --response--. Column 6, claim 1, line 7, cancel "powtion" and substitute --portion--. Column 6, claim 1, line 9, cancel "faffle" and substitute --baffle--

Signed and Sealed this

*Fourth* Day of *August 1981*

[SEAL]

*Attest:*

GERALD J. MOSSINGHOFF

*Attesting Officer*

*Commissioner of Patents and Trademarks*